US006310580B2

(12) United States Patent
Taniguchi et al.

(10) Patent No.: US 6,310,580 B2
(45) Date of Patent: Oct. 30, 2001

(54) ANTENNA STRUCTURE FOR VEHICLE

(75) Inventors: Tatsuaki Taniguchi; Kazuo Shigeta, both of Hiroshima-ken (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 09/761,725

(22) Filed: Jan. 18, 2001

(30) Foreign Application Priority Data

Jan. 28, 2000 (JP) ..... 12-020498

(51) Int. Cl.[7] ..... H01Q 1/32
(52) U.S. Cl. ..... 343/713; 343/728
(58) Field of Search ..... 343/713, 725, 343/711, 726, 727, 728, 741, 742, 866, 867

(56) References Cited

U.S. PATENT DOCUMENTS 3,832,714 8/1974 Cleminson et al. .
3,945,014 * 3/1976 Kunert et al. ..... 343/713
4,090,202 * 5/1978 Comastri et al. ..... 343/713
4,527,164 7/1985 Cestaro et al. ..... 343/713
6,002,373 * 12/1999 Taniguchi et al. ..... 343/713
6,008,767 12/1999 Taniguchi et al. ..... 343/713
6,160,518 * 12/2000 Miyahara et al. ..... 343/713

* cited by examiner

*Primary Examiner*—Tan Ho

(57) ABSTRACT

An antenna structure for a vehicle which includes an antenna which is disposed as a print or sticker antenna on a front window glass (FW) and is used to receive FM and AM waves, has a loop-shaped (e.g., reverse-convex-shaped) antenna element (1) which is disposed near the upper edge portion of the FW, one antenna element (2) which is connected in a DC manner to the lower side portion of the loop shape defined by the antenna element (1), and nearly vertically descends toward the lower edge portion of the FW substantially at its center in the widthwise direction of the vehicle, and a feeder distribution center (P) formed on the upper side portion of the loop shape defined by the antenna element (1), and the antenna elements (1, 2) are formed of silver paste containing dark carbon particles.

26 Claims, 20 Drawing Sheets

PATTERN 1

FIG. 5

AVERAGE DATA LIST (dB)

| | HORIZONTAL (H) POLARIZATION | VERTICAL (V) POLARIZATION |
|---|---|---|
| F_GLASS ANT | −9.9 | −4.4 |
| A_PILLAR ANT | −10.1 | −3.5 |

FIG. 6

| | FRONT GLASS ANTENNA | A-PILLAR ANTENNA |
|---|---|---|
| SAMPLE FREQUENCY (KHz) | LOSS (dB) | LOSS (dB) |
| 603 | 35.7 | 37.7 |
| 999 | 37.0 | 39.0 |
| 1404 | 35.8 | 37.8 |

AVERAGE DATA LIST (dB)

| | HORIZONTAL (H) POLARIZATION | VERTICAL (V) POLARIZATION |
|---|---|---|
| F_GLASS T = 52cm Y = 60cm | −13.9 | −9.1 |
| F_GLASS T = 52cm Y = 40cm | −12.5 | −8.1 |
| F_GLASS T = 52cm Y = 30cm | −11.7 | −7.5 |
| F_GLASS T = 52cm Y = 20cm | −11.1 | −7.2 |
| F_GLASS T = 52cm Y = 15cm | −10.7 | −6.9 |

PATTERN 2

FIG. 12

UNIT : dB

| SAMPLE FREQUENCY (KHz) | PATTERN 2 | MONO-POLE |
|---|---|---|
| 702 | 36.0 | 38 |
| 1071 | 36.2 | 38.4 |
| 1350 | 33.2 | 35.8 |

AVERAGE DATA LIST (dB)

| | HORIZONTAL (H) POLARIZATION | VERTICAL (V) POLARIZATION |
|---|---|---|
| PATTERN 1 | −10.7 | −5.6 |
| PATTERN 2 | −10.8 | −6.1 |
| PATTERN 3 | −10.2 | −5.9 |
| PATTERN 4 | −10.4 | −4.8 |

FIG. 21

AVERAGE DATA LIST (dB)

| | HORIZONTAL (H) POLARIZATION | VERTICAL (V) POLARIZATION |
|---|---|---|
| F_GLASS (CUT1) | −10.2 | −5.8 |
| F_GLASS (CUT2) | −10.4 | −6.3 |
| F_GLASS (NORMAL) | −10.3 | −6.0 |
| A_PILLAR | −10.2 | −4.2 |

ANTENNA STRUCTURE FOR VEHICLE

FIELD OF THE INVENTION

The present invention relates to an antenna structure for a vehicle, which includes an antenna element disposed on a window glass of an automobile or the like.

BACKGROUND OF THE INVENTION

In the field of automobiles as representative vehicles, a so-called glass antenna, which is disposed as a print or sticker antenna on the surface of a window glass such as a front window, and receives radio wave (signal wave) outside the vehicle, has been proposed.

As an example of such glass antenna, preceding Japanese Patent Laid-Open No. 9-130124 by the present applicant and U.S. Pat. No. 6,008,767 as its corresponding U.S. application propose an antenna structure for a vehicle that disposes a reverse-convex-shaped antenna element (that is, the antenna element has convex shape in lower direction) on a front window to receive TV (television) radio wave.

According to the aforementioned prior arts, TV radio wave can be satisfactorily received in a vehicle on the move without any antenna element that protrudes outside the vehicle.

However, as general characteristics of an antenna element, since the optimal size and shape largely vary depending on the wavelength (frequency range) of radio wave to be received, a reverse-convex-shaped antenna element must have a considerably large size if it is used as that for receiving FM (frequency modulation) or AM (amplitude modulation) wave, and as such it disturbs the driver's sight on the front window.

When an antenna element is formed as a print antenna, if the pattern of the antenna element is partially disconnected for some reason (e.g., upon cleaning, exchanging an automobile inspection sticker, or the like), the reception characteristics of the antenna element considerably change from original reception characteristics. If an antenna element having a large size is used on the surface (the surface on the passenger room side) of a front window glass to satisfactorily receive FM or AM wave, troubles due to such pattern disconnection are highly likely to occur.

SUMMARY OF THE INVENTION

It is, therefore, an object of the present invention to provide an antenna structure for a vehicle, which satisfactorily receives FM and AM waves on a front window glass without disturbing driver's sight.

In order to achieve the above object, a first antenna structure for a vehicle according to the present invention is characterized by the following arrangement.

That is, an antenna structure for a vehicle including an antenna which is disposed on a front window glass (11) and is used to receive FM and AM waves, is characterized by comprising a loop-shaped first antenna element (1) disposed near an upper edge portion of the front window glass, one second antenna element (2) which is connected in a DC manner to a lower side portion of the loop shape defined by the first antenna element, and has a lower end portion vertically descending toward a lower edge portion of the front window glass, and a feeder distribution center (P) provided to an upper side portion of the loop shape defined by the first antenna element (see FIG. 1).

According to the antenna structure for a vehicle, FM and AM waves can be satisfactorily received on the front window glass without disturbing driver's sight.

In the first antenna structure for a vehicle, the first and second antenna elements (e.g., print antenna elements) are preferably formed of silver paste containing dark carbon particles. With this structure, the resistance (impedance) can be adjusted to a desired value without increasing the width of each antenna element, and driver's sight can be prevented from being impaired.

Also, the first antenna element is formed into, e.g., a reverse-convex shape, and a base (13) of a rearview mirror (14) is disposed inside the reverse-convex shaped portion (see FIG. 2). With this structure, since the rearview mirror is attached to the base inside of the reverse-convex shaped portion, and the first antenna element is hidden from the vision of a passenger, appearance of the antenna can be improved.

Alternatively, in order to achieve the above object, a second antenna structure for a vehicle, including an antenna which is disposed on a front window glass (11) as a print antenna and is used to receive FM and AM waves, is characterized by comprising a C-shaped first antenna element (5) which is disposed near an upper edge portion of the front window glass and has an opening facing a lower edge portion of the front window glass, two second antenna elements (6) which are respectively connected to ends of the C-shaped opening defined by the first antenna element, and substantially vertically descend toward the lower edge portion of the front window glass to have a spacing smaller than a maximum width of the first antenna element in a widthwise direction of a vehicle, a third antenna element (7) which is connected in a DC manner to positions different from lower end portions of the second antenna elements so as to connect the two second antenna elements to each other, and a feeder distribution center (P) provided to an upper side portion of the C shape defined by the first antenna element (see FIG. 10).

According to the antenna structure for a vehicle, FM and AM waves can be satisfactorily received on the front window glass without disturbing driver's sight. Furthermore, according to the antenna structure for a vehicle, when the second antenna element is disposed on the front window glass as a print antenna, and is disconnected at some position, the predetermined effective length of the antenna element can be prevented from becoming extremely short, thus minimizing deterioration of predetermined reception performance.

In the second antenna structure for a vehicle, the first to third antenna elements are preferably formed of silver paste containing dark carbon particles. With this structure, the resistance (impedance) can be adjusted to a desired value without increasing the width of each antenna element, and driver's sight can be prevented from being impaired.

For example, the third antenna element is preferably disposed on the front window glass at a level of a back surface of a rear view mirror. With this structure, since the third antenna element is hidden by the rearview mirror from the vision of a passenger, appearance of the antenna can be improved.

At this time, the third antenna element may be connected to upper end portions of the two second antenna elements to define a loop shape together with the C-shaped first antenna element (see FIG. 22), or a plurality of third antenna elements equivalent to the third antenna element may be disposed at vertically different positions of the two second antenna elements (see FIGS. 13 and 14).

In the first or second antenna structure for a vehicle, at least the second antenna element is preferably disposed at substantially the center of the front window glass in the widthwise direction of the vehicle. With this structure, reception performance can be maximized on the front window glass.

Preferably, the first antenna element is preferably disposed on the front window glass above a level of a lower end portion of a rearview mirror (14). With this structure, since the first antenna element is hidden by the rearview mirror from the vision of a passenger, the appearance of the antenna can be improved.

For example, a shield member is preferably provided between the second antenna element and an electronic device equipped inside an instrument panel below the front window glass to shield electrical connection therebetween.

In a preferred embodiment, the shield member may use conductive paint applied to a cover of the instrument panel, a cover of the instrument panel which is made of a conductive resin material, or a conductive planar or mesh material disposed along the instrument panel.

According to the aforementioned structure, reception performance can be prevented from being adversely influenced by electrical noise generated by an electronic device arranged inside the instrument panel.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 5 is a table showing the comparison results of reception sensitivity average values of horizontally and vertically polarized FM waves of an antenna of pattern 1 and A-pillar antenna;

FIG. 6 is a table showing the comparison results of reception sensitivities of AM wave of an antenna of pattern 1 and A-pillar antenna;

FIG. 12 is a table showing the evaluation results of reception performances of an antenna of pattern 2 and the mono-pole antenna;

FIG. 21 is a table showing the comparison results of reception sensitivity average values of horizontally and vertically polarized FM waves upon disconnecting an antenna of pattern 3.

DESCRIPTION OF THE PREFERRED EMBODIMENTS

Embodiments in which an antenna structure for a vehicle according to the present invention is applied to an automobile as a representative vehicle will be explained in detail hereinafter with reference to the accompanying drawings.

First Embodiment

Figure 1:
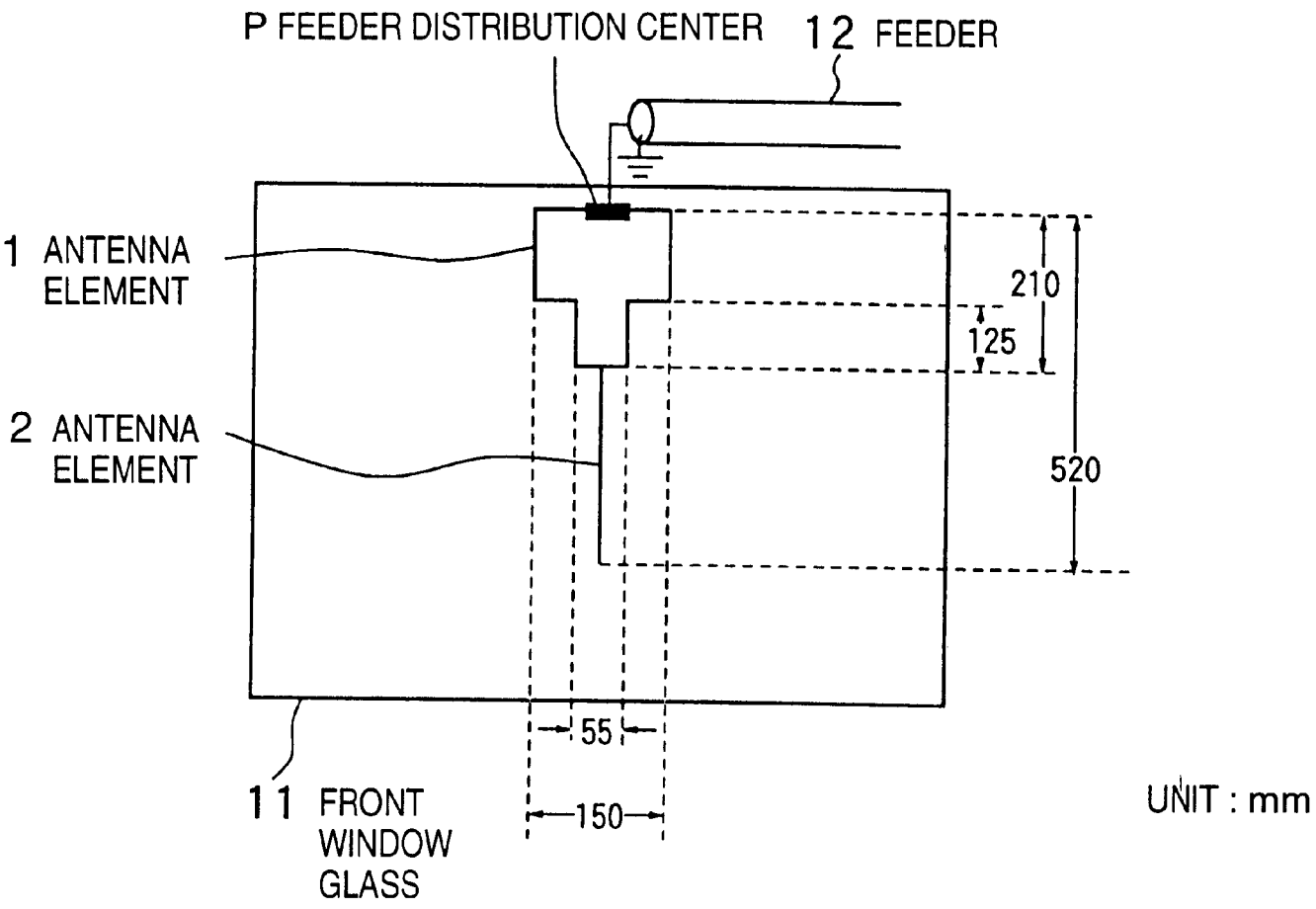
FIG. 1 is a view showing an antenna structure for a vehicle according to the first embodiment.

FIG. 1 shows an antenna structure for a vehicle according to the first embodiment, and exemplifies an antenna structure disposed on a front window glass.

The antenna structure for a vehicle shown in FIG. 1 includes an antenna for receiving FM and AM waves, which antenna includes three elements:

- a loop-shaped (reverse-convex-shaped in this embodiment) antenna element 1 (first antenna element) disposed near the upper edge portion of a front window glass 11;
- a single antenna element 2 (second antenna element) which is connected in a DC manner to the lower side portion of the loop shape formed by the first antenna element 1 (i.e., antenna conductors are physically connected to each other), and has a lower end portion nearly vertically descending toward the lower edge portion of the front window glass 11; and
- a feeder distribution center P which is formed on the upper side portion of the loop shape of the first antenna element 1 and is connected to a feeder 12. In the following description, the shape of the antenna will be referred to as pattern 1 for the sake of simplicity.

Note that the dimensions of the antenna of pattern 1 shown in FIG. 1 merely exemplify a size on the front window glass 11, and are not limited to those values (a change in reception performance due to different dimensions will be explained later).

The antenna of pattern 1 can be applied to either a print or sticker antenna.

In general, as characteristics required for a conductor that forms an antenna element, it must have a lowest possible resistance, and silver is known as a low-resistance material. However, when silver with high reflectance of light is simply used as the conductor of the antenna element according to this embodiment, since the antenna element which is disposed on the surface of the front window glass 11 interferes with the passenger's view irrespective of the conductor width, the forward passenger's sight impairs considerably.

To solve the above described problem, this embodiment adopts silver paste containing dark carbon particles as a conductor that forms the antenna of pattern 1 (i.e., the antenna elements 1 and 2). With this material, each antenna element can be realized by a thin wire having a width of around 0.5 mm, and the antenna conductor itself can have dark color with low reflectance, thus preventing driver's sight from impairing. By appropriately adjusting the content of carbon particles, the resistance (impedance) can be adjusted to a desired value.

Figure 2:
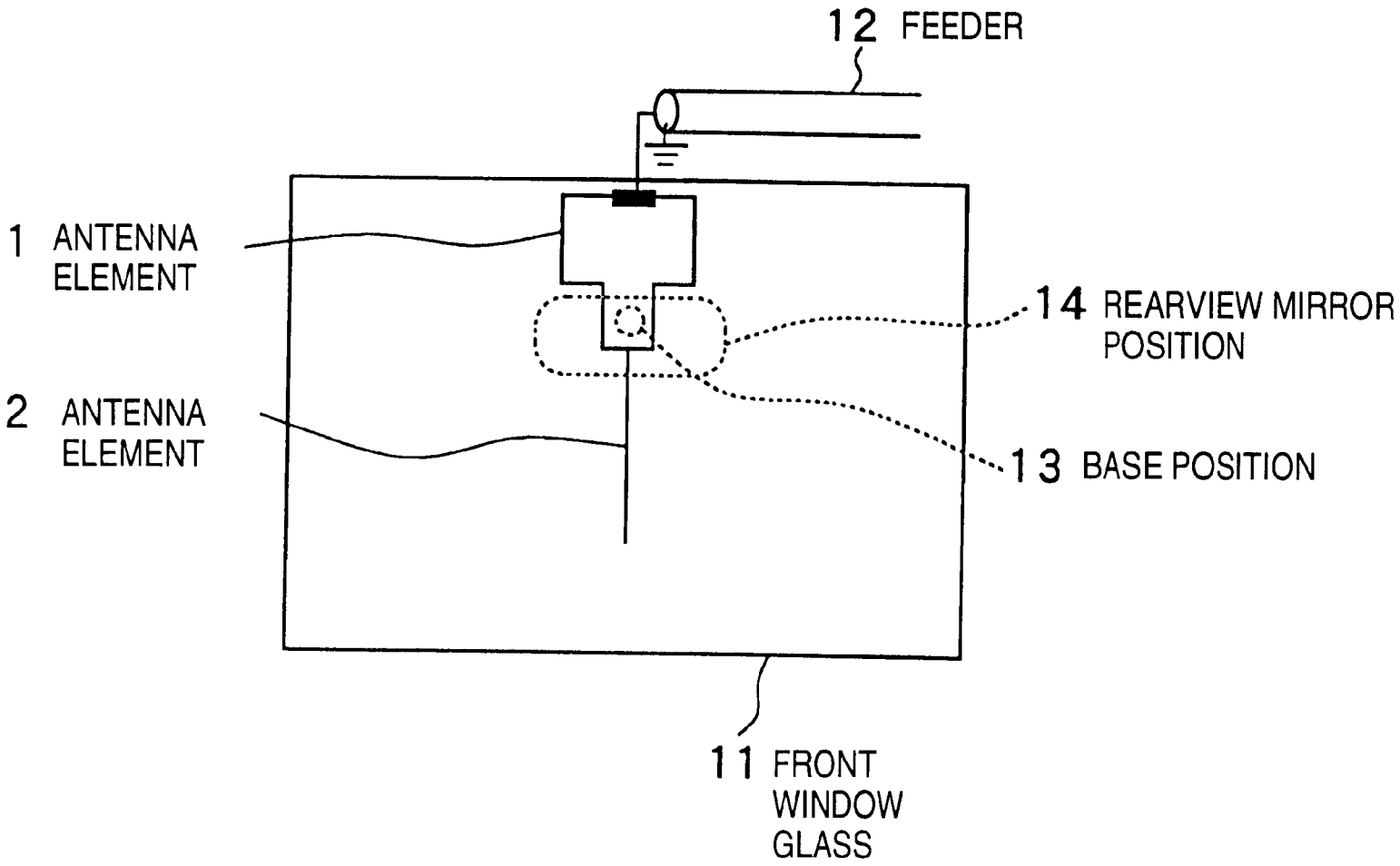
FIG. 2 is a view for explaining advantages when a rearview mirror is disposed on a front window glass that adopts the antenna structure for a vehicle according to the first embodiment.

FIG. 2 is a view for explaining advantages when a rearview mirror is disposed on the front window glass that adopts the antenna structure for a vehicle according to the first embodiment.

In a preferred embodiment of the antenna of pattern 1, the antenna element 1 is formed in a reverse-convex shape (convex shape in lower direction), and the interior of the vertical line of the reverse-convex shape is preferably defined as a base attachment position 13 of a rearview mirror. With this layout, the antenna element 1 is disposed above the level of the lower end portion of the rearview mirror on the front window glass 11. In this case, since a passenger who sits on a seat obliquely looks up toward the upper portion of the front window glass 11, if the rearview mirror is attached using the base attachment position 13, it can be attached, as indicated by an attachment position 14, and the antenna element 1 can be hidden from the vision of the passenger, thus improving appearance.

In this embodiment, when at least the antenna element 2 is disposed at nearly the center of the front window glass 11 in the widthwise direction of a vehicle, the antenna element 2 can be disposed at a nearly symmetric position with respect to A pillars (front pillars) on the two sides in the widthwise direction of the vehicle, and reception performance can be maximized. Since the antenna 2 is disposed at a nearly symmetric position in the widthwise direction of the vehicle, a passenger feels less physiologically disrupted.

In order to satisfactorily receive FM wave by the antenna elements according to this embodiment, the antenna element 2 must descend to a position near the lower edge portion of the front window glass 11, as shown in FIGS. 1 and 2. Electronic devices arranged in an instrument panel below the front window glass normally generate various electrical noise components at the beginning of or during their operations.

In the antenna structure according to this embodiment, a shielding member for shielding electrical connections between the antenna element 2 and electronic devices arranged in the instrument panel (dashboard) below the front window glass is disposed. As such shielding member, a method of painting the cover of the instrument panel with conductive paint or adopting a member formed of a conductive resin material, disposing a conductive planar material or mesh material along the instrument panel, or the like may be used. In this manner, the reception performance can be prevented from being adversely influenced by electrical noise generated by electronic devices arranged in the instrument panel.

Evaluation of Reception Performance

The evaluation result of the reception performance of the antenna elements according to this embodiment will be explained below.

In evaluation tests of the reception performance by the present applicant, the antenna of pattern 1 and a so-called A-pillar antenna which protrudes outside the vehicle body along an A pillar which forms the vehicle body of an automobile were compared. The frequency ranges to be evaluated include a horizontally polarized FM wave frequency range from 76 MHz to 90 MHz for Japan, a vertically polarized FM wave frequency range from 90 MHz to 108 MHz for USA, and an AM wave frequency range from 530 kHz to 1,700 kHz. The test results will be explained below.

<Reception Performance Evaluation of FM Wave>

Figure 3:
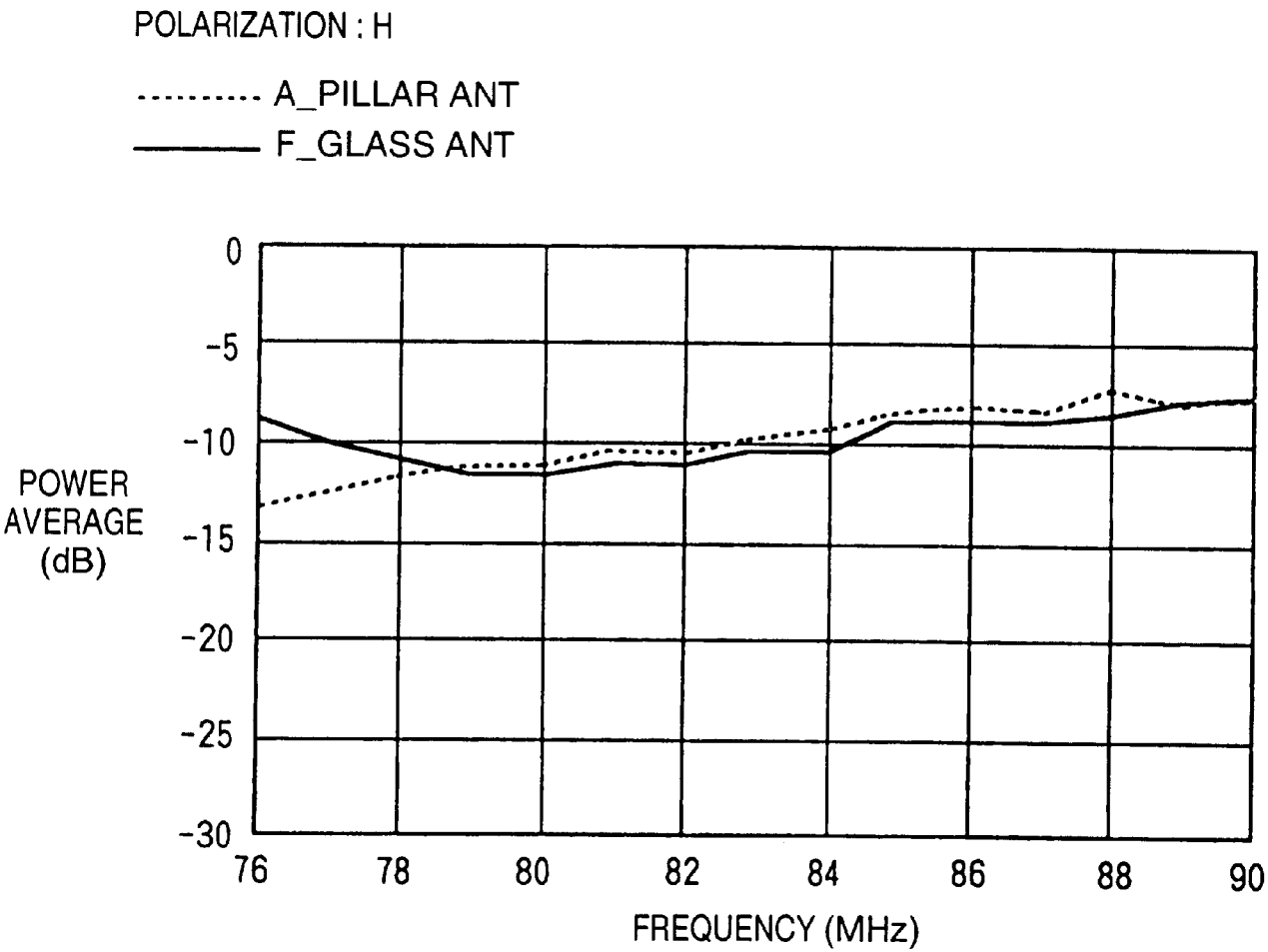
FIG. 3 is a graph showing the comparison results of reception performances of horizontally polarized FM wave of an antenna of pattern 1 and A-pillar antenna.
Figure 4:
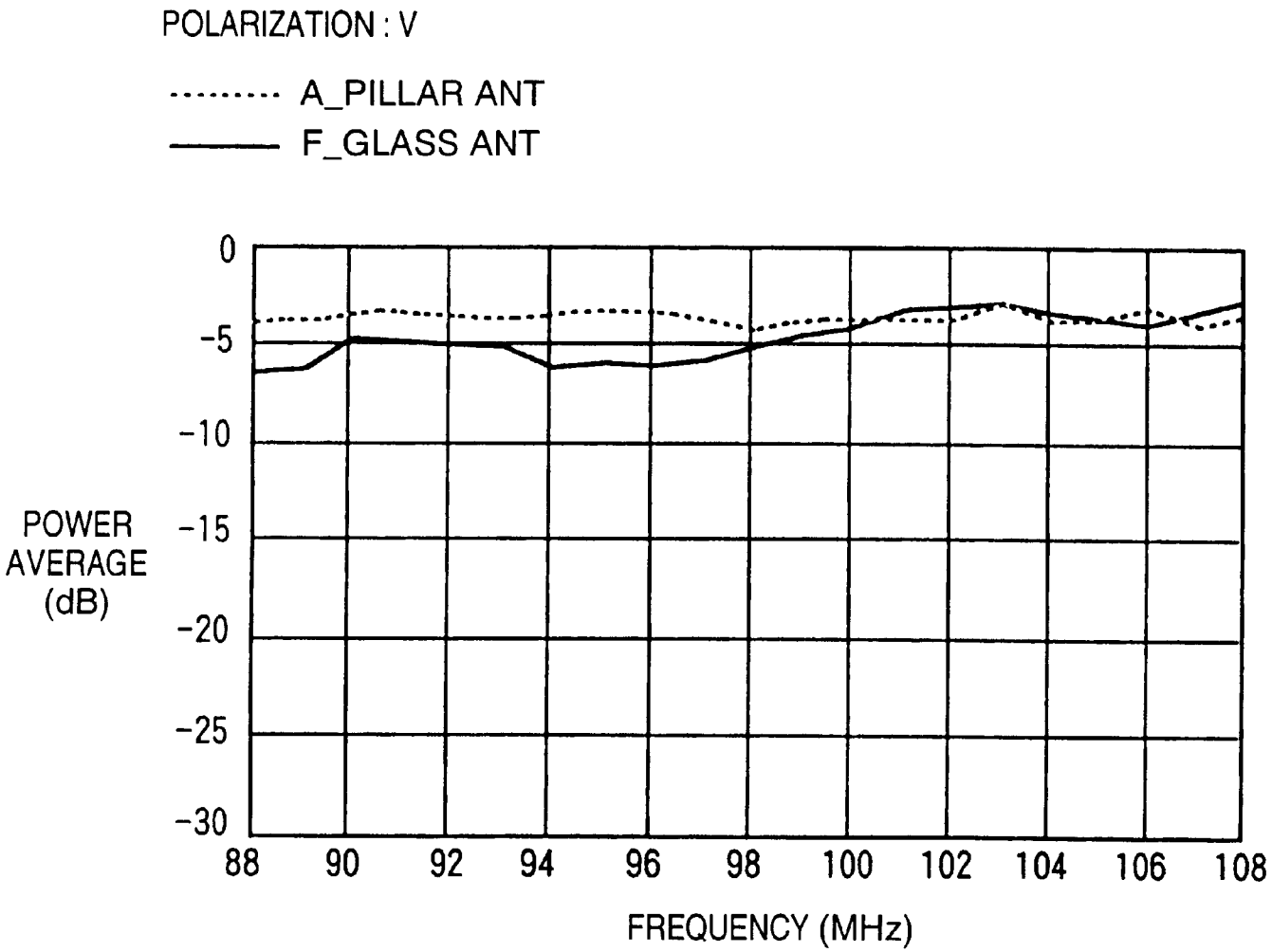
FIG. 4 is a graph showing the comparison results of reception performances of vertically polarized FM wave of an antenna of pattern 1 and A-pillar antenna.

FIG. 3 is a graph showing the comparison results of reception performances of horizontally polarized FM wave of the antenna of pattern 1 and A-pillar antenna. FIG. 4 is graph showing the comparison results of reception performances of vertically polarized FM wave of the antenna of pattern 1 and A-pillar antenna. FIG. 5 is a table showing the comparison results of reception sensitivity average values of horizontally and vertically polarized FM waves of the antenna of pattern 1 and A-pillar antenna.

Upon examining the results shown in FIGS. 3 to 5, the antenna of pattern 1 has reception sensitivity equivalent to that of a general A-pillar antenna.

<Reception Performance Evaluation of AM Wave>

FIG. 6 is a table showing the comparison results of reception sensitivities of AM wave of the antenna of pattern 1 and A-pillar antenna. In tests, the two antennas were compared at sample frequencies of 603 kHz, 999 kHz, and 1,404 kHz within a predetermined frequency range from 530 kHz to 1,404 kHz.

In FIG. 6, a loss (dB) is a value obtained by subtracting an antenna induced voltage (dB) from an antenna electric field strength (dB$\mu$V/m), and the antenna of pattern 1 according to this embodiment suffers losses around 2 dB lower than those of the A-pillar antenna at all sample frequencies (i.e., the antenna of this embodiment has superior reception sensitivity of AM wave in the corresponding frequency range).

Evaluation of Influence of Different Dimensions on Reception Performance

The evaluation results of reception performance of the antenna of pattern 1 according to this embodiment due to different element dimensions will be explained below.

<Reception Performance Evaluation of FM Wave>

Figure 7:
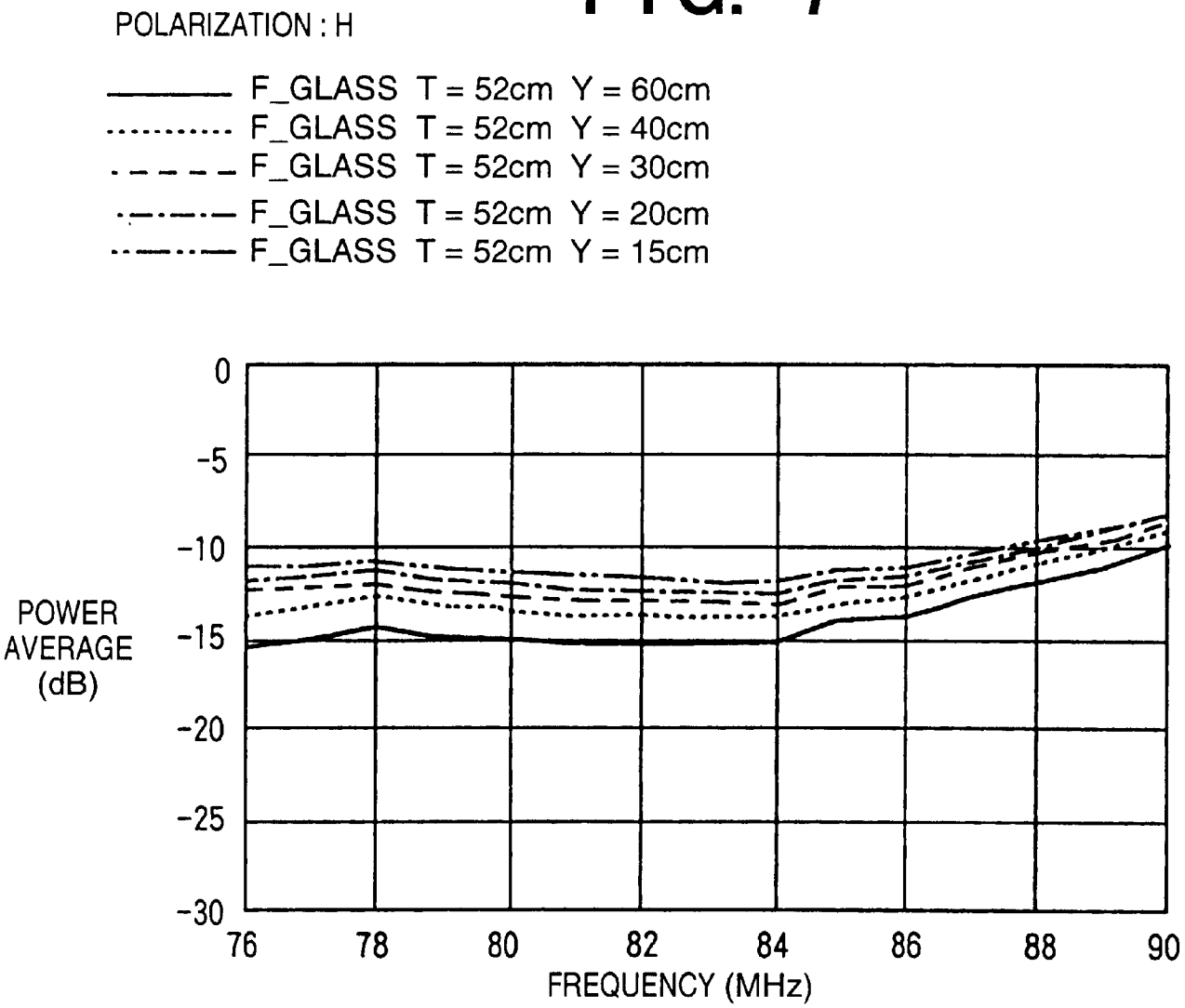
FIG. 7 is a graph showing the comparison results of reception performances of horizontally polarized FM wave of five different antennas of pattern 1 having different dimensions.
Figure 8:
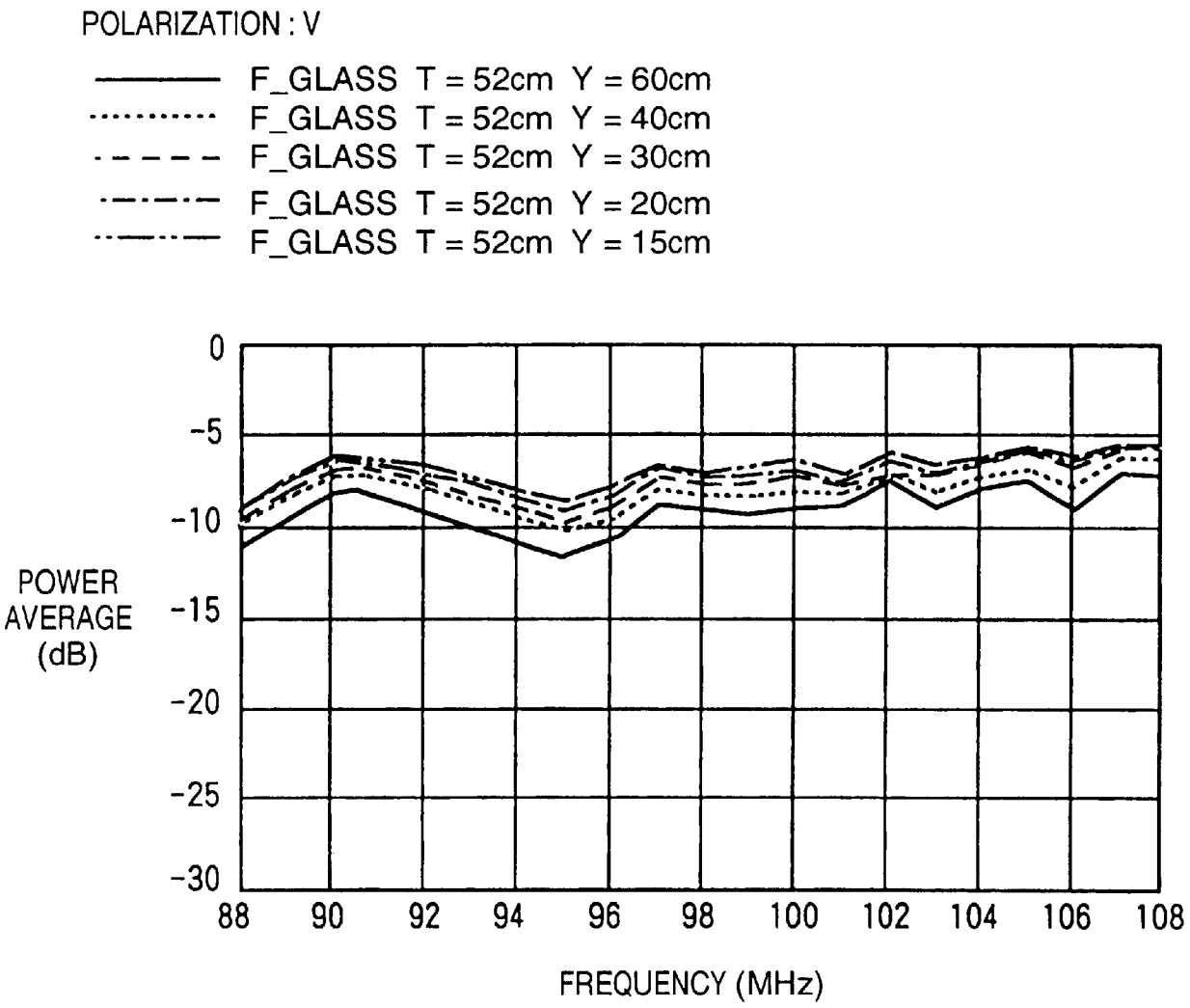
FIG. 8 is a graph showing the comparison results of reception performances of vertically polarized FM wave of five different antennas of pattern 1 having different dimensions.
Figure 9:
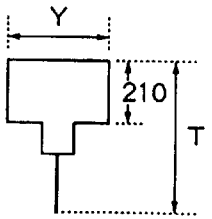
FIG. 9 is a table showing the comparison results of reception sensitivity average values of horizontally and vertically polarized FM waves of five different antennas of pattern 1 having different dimensions.

FIG. 7 is a graph showing the comparison results of the reception performances of horizontally polarized FM wave of five different antennas of pattern 1 having different dimensions. FIG. 8 is a graph showing the comparison results of the reception performances of vertically polarized FM wave of five different antennas of pattern 1 having different dimensions. FIG. 9 is a table showing the comparison results of reception sensitivity average values of horizontally and vertically polarized FM waves of five different antennas of pattern 1 having different dimensions.

Tests were conducted for antenna elements which have a vertical length T of 52 cm of the antenna elements 1 and 2 of the front window glass, and five different lengths Y (Y=60 cm, 40 cm, 30 cm, 20 cm, and 15 cm) of the upper side of the antenna element 1. Other dimensions are the same as those described in FIG. 1.

Upon examining the results shown in FIGS. 7 to 9, five different antennas of pattern 1 suffer larger losses with increasing length Y of the upper side of the antenna element 1 when FM wave is to be received. This means that the element having the smallest length Y of the antenna element 1 of the five sets of antenna elements has the best reception performance, and the small length Y results in good appearance since the reverse-convex-shaped conductor of the antenna element 1 is hidden behind the rearview mirror upon being disposed on the front window glass.

The aforementioned evaluation results reveal that even when the horizontal length Y of the antenna element 1 in the antenna of pattern 1 changes to be nearly equal to the vertical length (52 cm) of the antenna of pattern 1, the reception sensitivity suffers only a difference in loss of several dB, as opposed to general characteristics in which the reception sensitivity of an antenna largely changes due to slightly different effective lengths of antenna elements with respect to the ground surface. As can be seen from the above description, the horizontal length (length Y) of the antenna element 1 has a considerably low degree of contribution to the reception sensitivity compared to a difference in vertical length of the antenna of pattern 1.

<Reception Performance Evaluation of AM Wave>

The present applicant obtained substantially the same results as the reception performance of the antenna of pattern 1 that has been explained with reference to FIG. 6 in measurements of AM wave using the five different antennas of pattern 1. That is, the five different antennas of pattern 1 have around 2 dB better reception performances than the A-pillar antenna at all sample frequencies.

As described above, according to this embodiment, FM and AM waves can be satisfactorily received on the front window glass without disturbing driver's sight.

Second Embodiment

The second embodiment based on the antenna structure for a vehicle according to the first embodiment will be explained below. Antenna elements according to this embodiment aim at satisfactorily receiving FM and AM waves on the front window glass without disturbing driver's sight as in the first embodiment, and suppressing any variation of reception sensitivity upon disconnecting an antenna conductor compared to the first embodiment. Therefore, an antenna structure for a vehicle according to this embodiment is particularly suitable for a print antenna which is not easy to repair upon disconnecting a conductor.

Figure 10:
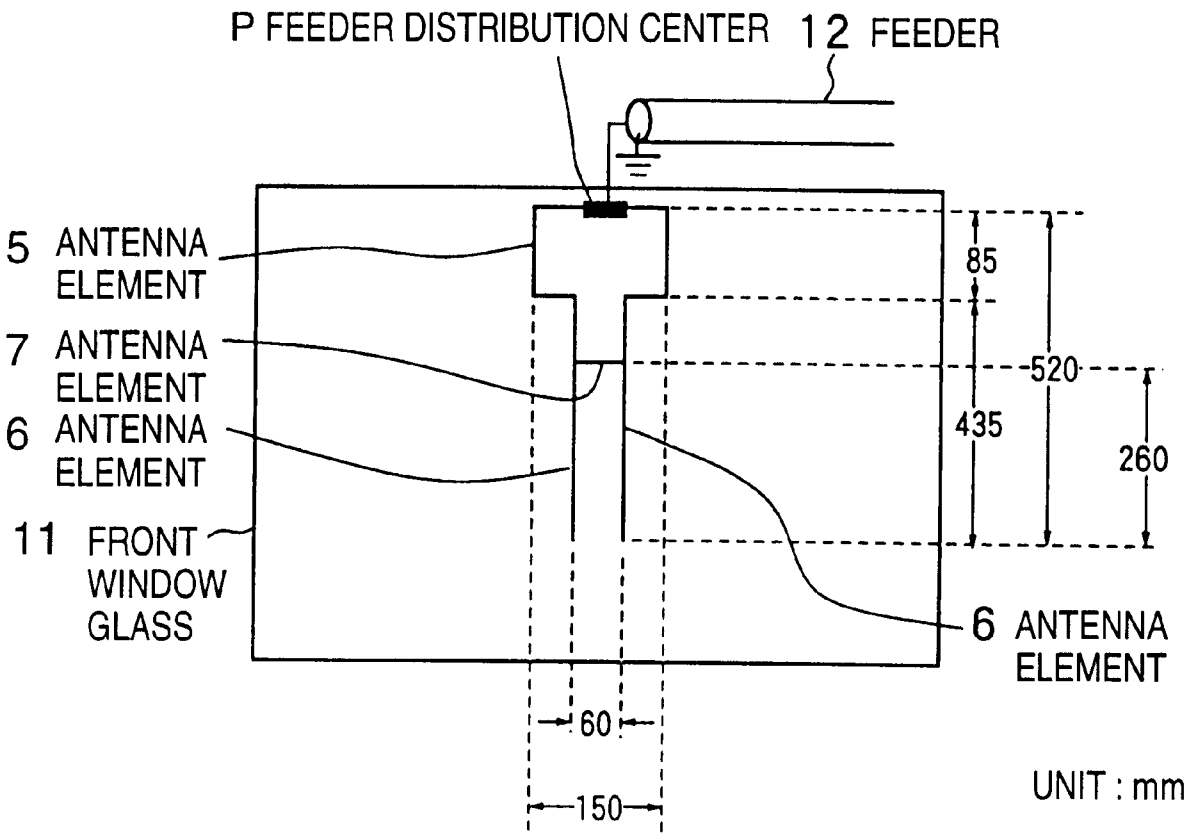
FIG. 10 is a view showing an antenna structure for a vehicle according to the second embodiment.

FIG. 10 shows an antenna structure for a vehicle according to the second embodiment, and exemplifies an antenna structure disposed on a front window glass.

The antenna structure for a vehicle shown in FIG. 10 includes antenna elements for receiving FM and AM waves, which comprise a C-shaped antenna element 5 (first antenna element) which is disposed near the upper edge portion of the front window glass 11 and is open toward the lower edge portion of the front window glass 11, two antenna elements 6 (second antenna elements) which are respectively connected to open ends of the C shape defined by the antenna element 5 in a DC manner, and nearly vertically descend toward the lower edge portion of the front window glass 11, an antenna element 7 which is nearly horizontally connected in a DC manner at a position different from the upper end portions of these two antenna elements 6, and a feeder distribution center P which is provided to the upper side portion of the C shape defined by the antenna element 5 and is connected to the feeder 12.

That is, the antenna elements shown in FIG. 10 include a reverse-convex-shaped conductor loop since the upper end portions of the two antenna elements 6 are connected to the open ends of the C shape smaller than the maximum width of the antenna element 5 in the widthwise direction of a vehicle, and the antenna element 7 is connected at a position different from the upper end portions of the two antenna elements 6.

In this embodiment, the position and number of antenna elements 7 are not limited to a pattern shown in FIG. 10, as will be described in detail later. In the following description, the shape of the antenna elements shown in FIG. 10 will be referred to as pattern 2.

Note that the dimensions of the antenna of pattern 1 shown in FIG. 10 merely exemplify a size on the front window glass 11, and are not limited to those values.

In this embodiment, the antenna elements 5 to 7 that form the antenna of pattern 2 preferably adopt silver paste containing dark carbon particles so as to prevent driver's sight from being disturbed using a thin wire having a width of around 0.5 mm and to realize a desired resistance (impedance), as in the first embodiment.

In this embodiment as well, in order to practically hide the antenna element 1 from the vision of a passenger as in the first embodiment, a rearview mirror is preferably attached using the inner space of the vertical line of the reverse-convex-shaped portion of the C-shaped antenna element 5. When the position of the antenna element 7 that couples the two antenna elements 6 is set at the level of the back surface of the rearview mirror on the front window glass 11, the antenna element 7 is also hidden from the vision of the passenger, thus further improving appearance.

In this embodiment, in order to improve the reception performance as in the first embodiment, at least the two antenna elements 6 (strictly speaking, the central position of the two antenna elements 6 which are disposed to be separate from each other) are set at nearly the center of the front window glass 11 in the widthwise direction of the vehicle.

In this embodiment, in order to shield electrical connections with electronic devices arranged in an instrument panel (dashboard) as in the first embodiment, a shield member is preferably added by one of various methods mentioned above.

<Reception Performance Evaluation of Pattern 2 and Mono-pole type Antenna>

Figure 11:
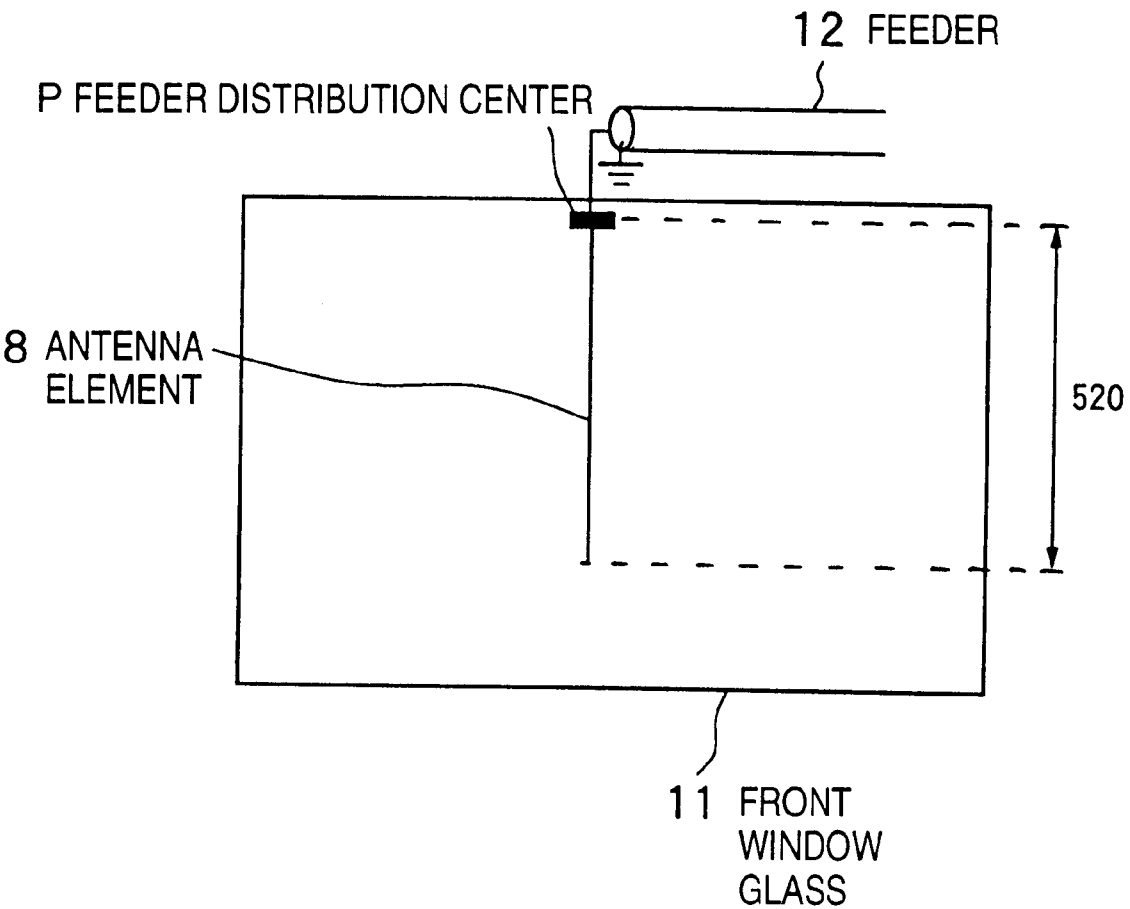
FIG. 11 is a view showing an antenna structure for a vehicle including a mono-pole type antenna element.

FIG. 11 shows an antenna structure for a vehicle including a mono-pole type antenna element.

An antenna element 8 shown in FIG. 11 is disposed at, e.g., nearly the center of the front window glass 11 in the widthwise direction of the vehicle, and is made of a silver paste conductor containing carbon particles as in the antennas of patterns 1 and 2 mentioned above.

FIG. 12 shows the evaluation results of reception performances of the antenna of pattern 2 and the mono-pole type antenna, and the present applicant compared the reception sensitivities of the antenna of pattern 2 according to this embodiment, and the mono-pole type antenna element 8 shown in FIG. 11 at sample frequencies of 702 kHz, 1,071 kHz, and 1,350 kHz.

As can be seen from the comparison results of the antenna of pattern 2 and the mono-pole type antenna element 8 shown in FIG. 12, the antenna of pattern 2 suffers losses around 2 dB lower than those of the mono-pole type antenna element 8 at the respective sample frequencies.

<Modification of Antenna of This Embodiment>

Various modifications based on the antenna of pattern 2 mentioned above in this embodiment will be explained below.

Figure 13:
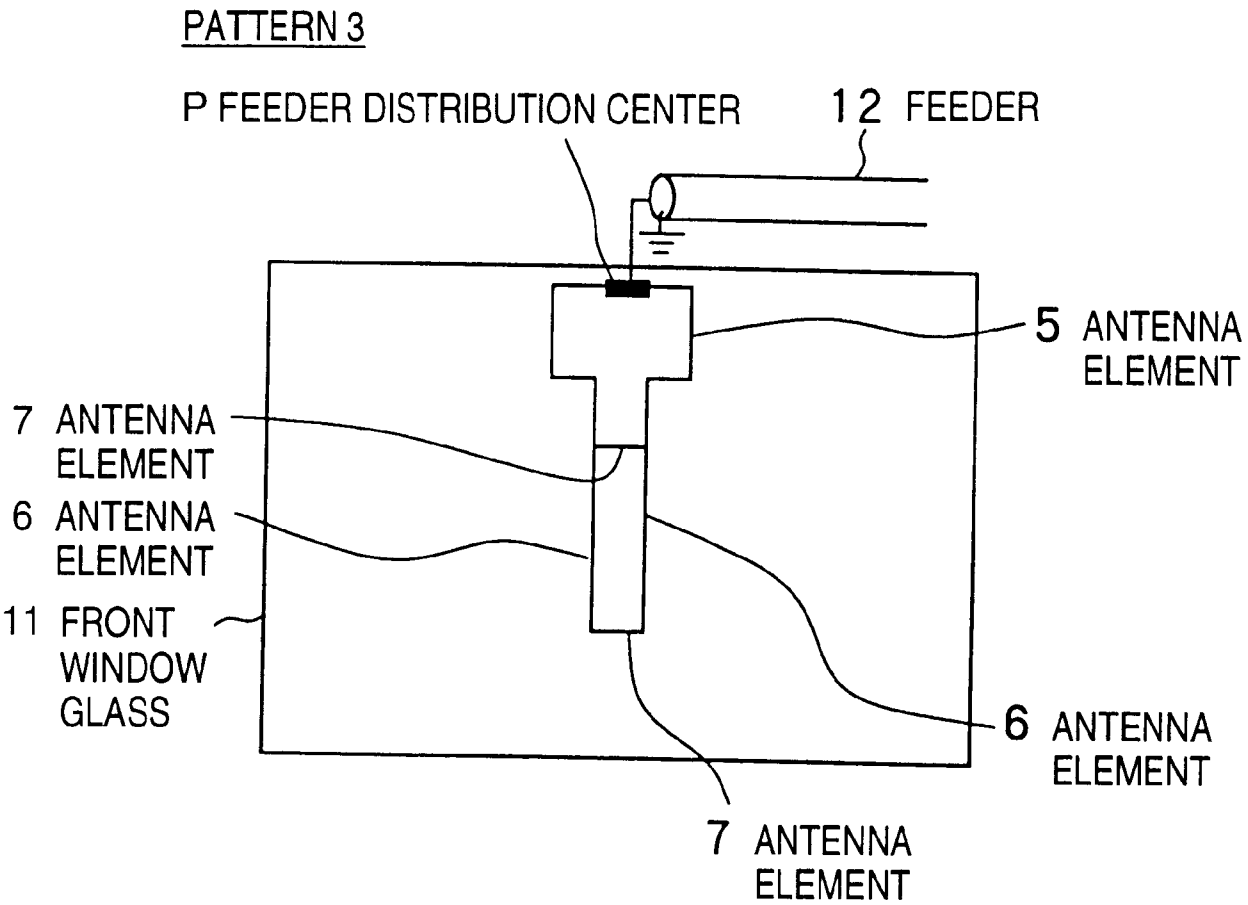
FIG. 13 is a view showing an antenna structure for a vehicle according to the first modification of the second embodiment.

FIG. 13 shows an antenna structure for a vehicle according to the first modification of the second embodiment.

An antenna (to be referred to as an antenna of pattern 3 hereinafter) shown in FIG. 13 is disposed on, e.g., the front window glass, and has two horizontal antenna elements 7 that connect the two antenna elements 6 in a DC manner unlike the antenna of pattern 1.

Figure 14:
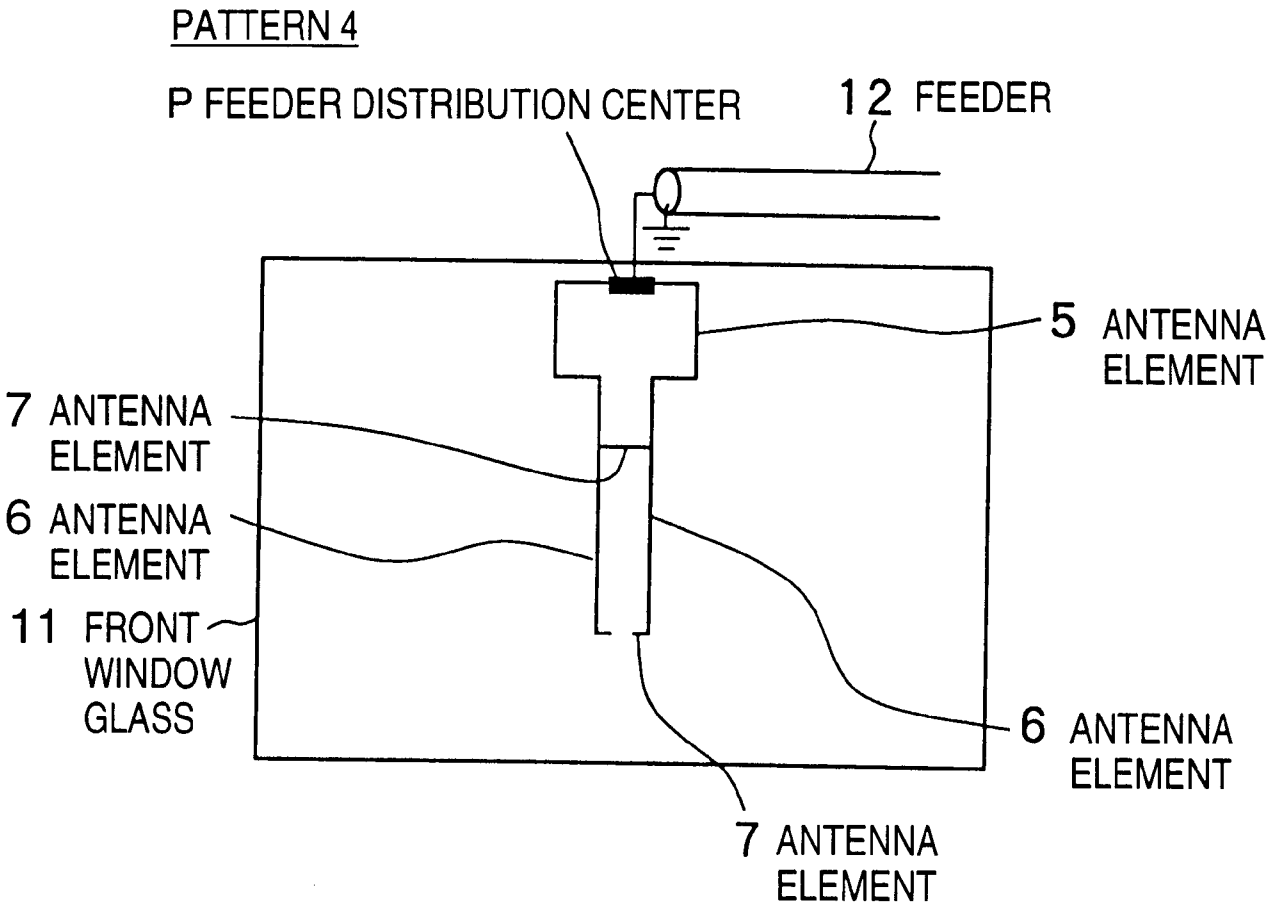
FIG. 14 is a view showing an antenna structure for a vehicle according to the second modification of the second embodiment.

FIG. 14 shows an antenna structure for a vehicle according to the second modification of the second embodiment.

An antenna (to be referred to as an antenna of pattern 4 hereinafter) shown in FIG. 14 is disposed on, e.g., the front window glass, and has two horizontal antenna elements 7 as in the antenna of pattern 3 but the element connected to the lower end portions of the two antenna elements 6 is partially cut.

The present applicant also compared the reception performances of the antennas of patterns 3 and 4 with the mono-pole antenna element 8 shown in FIG. 11. In this case, the antennas of patterns 3 and 4 suffer losses around 2 dB lower than those of the mono-pole type antenna element 8 at the respective sample frequencies, like in the results shown in FIG. 12.

[Evaluation of Reception Performance[

The evaluation results of the reception performances of the antennas of patterns 1 to 4 will be explained below.

In the evaluation tests of the reception performances conducted by the present applicant, the reception sensitivities of the antenna of pattern 1 described in the first embodiment, and the antennas of patterns 2 to 4 described in this embodiment were compared. The frequency ranges to be evaluated include a horizontally polarized FM wave frequency range from 76 MHz to 90 MHz for Japan, a vertically polarized FM wave frequency range from 90 MHz to 108 MHz for USA, and an AM wave frequency range from 530 kHz to 1,700 kHz. The test results will be explained below.

<Reception Performance Evaluation of FM Wave>

Figure 15:
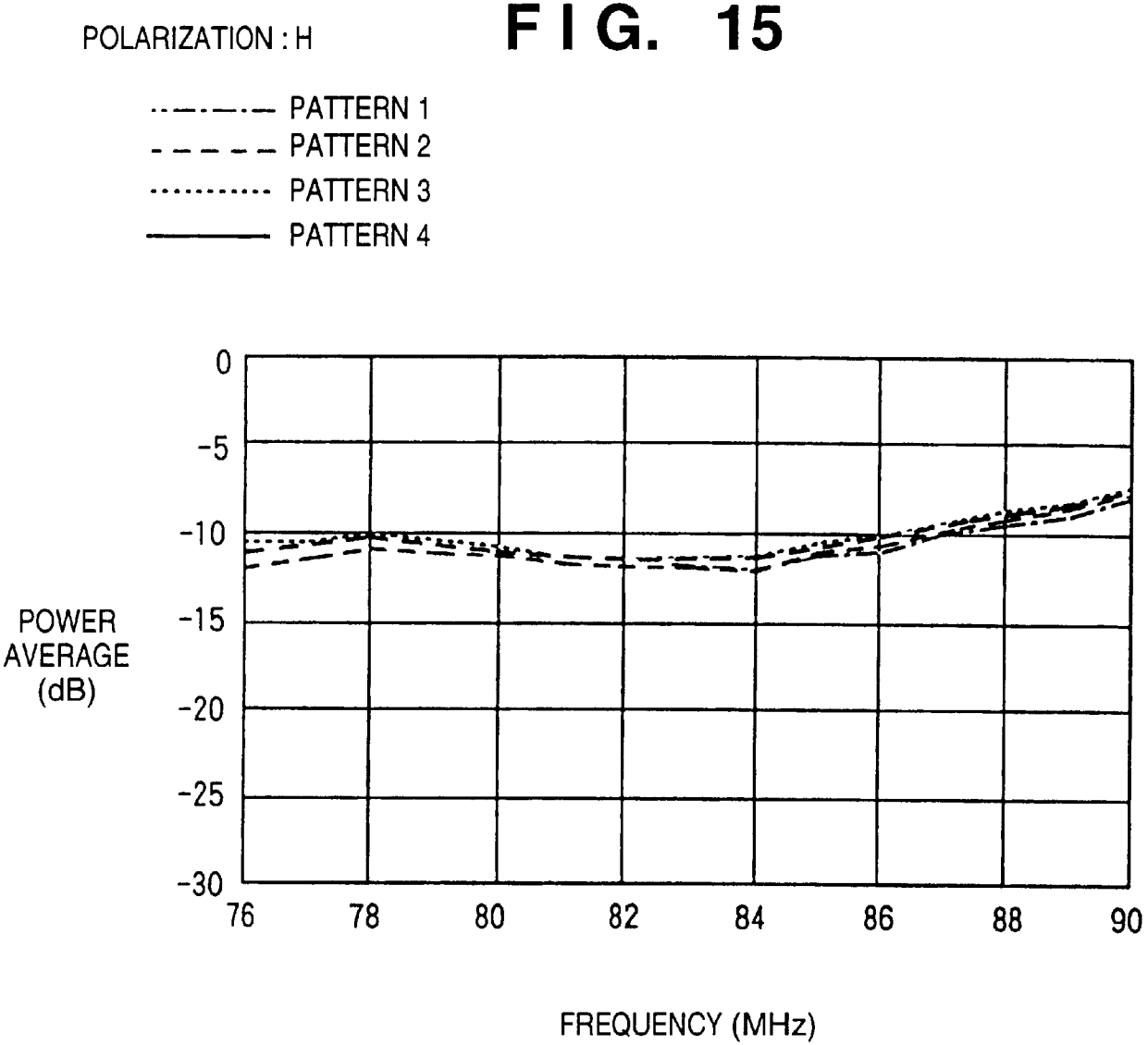
FIG. 15 is a graph showing the comparison results of reception performances of horizontally polarized FM wave of antennas of patterns 1 to 4.
Figure 16:
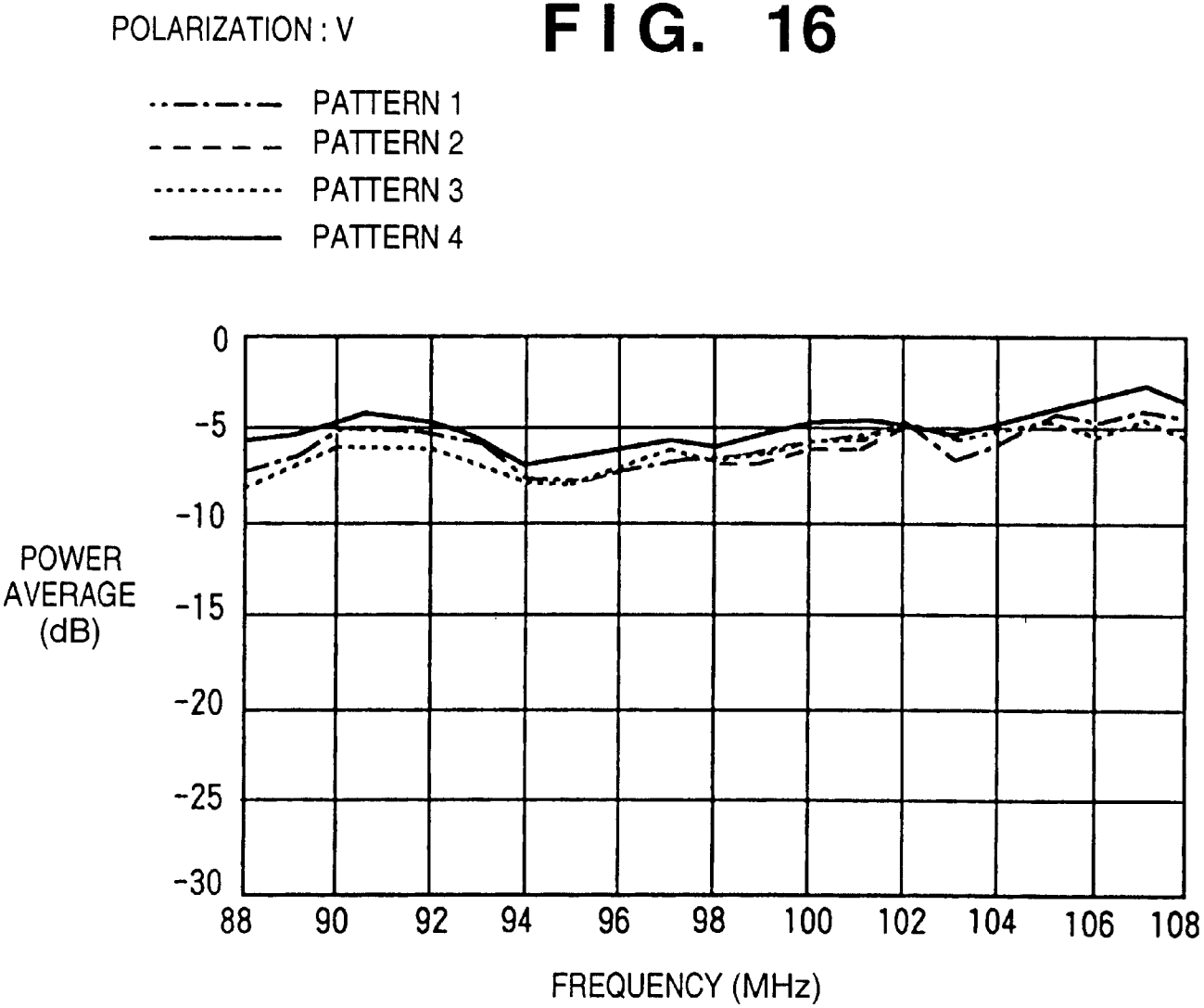
FIG. 16 is a graph showing the comparison results of reception performances of vertically polarized FM wave of antennas of patterns 1 to 4.
Figures 17, 18:
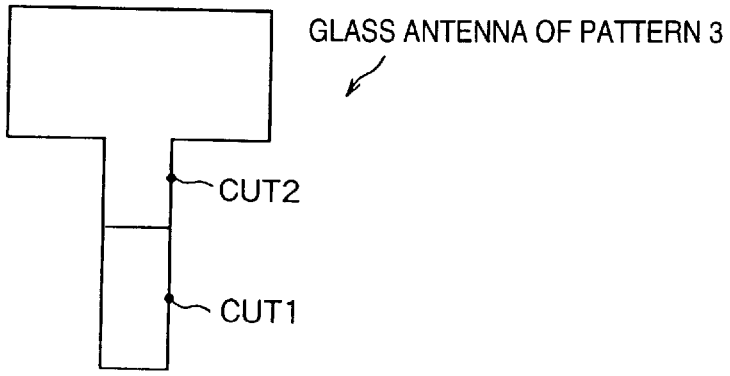
FIG. 17 is a table showing the comparison results of reception sensitivity average values of horizontally and vertically polarized FM waves of antennas of patterns 1 to 4.
FIG. 18 is a view for explaining portions where a conductor of an antenna of pattern 3 is disconnected in an evaluation test.

FIG. 15 is a graph showing the comparison results of reception performances of horizontally polarized FM wave of the antennas of patterns 1 to 4. FIG. 16 is a graph showing the comparison results of reception performances of vertically polarized FM wave of the antennas of patterns 1 to 4. FIG. 17 is a table showing the reception sensitivity average values of horizontally and vertically polarized FM waves of the antennas of patterns 1 to 4.

As can be seen from examinations of the results shown in FIGS. 15 to 17, the antennas of patterns 1 to 4 have equivalent reception sensitivities.

<Reception Performance Evaluation of AM Wave>

The present applicant also compared the reception sensitivities of AM wave ranging from 530 kHz to 1,700 kHz of the antennas of patterns 1 to 4 with the A-pillar antenna described in the first embodiment with reference to FIG. 6. As a result, the antennas of all the patterns suffer losses 2 dB lower than those of the A-pillar antenna at sample frequencies of 603 kHz, 999 kHz, and 1,404 kHz.

The present applicant made similar evaluations for patterns having different positions and numbers of antenna elements 7 in addition to the antennas of patterns 2 to 4. In these evaluations, only small performance differences were observed.

According to these evaluation results, in the antenna structures for a vehicle according to this embodiment, either the structure of antenna elements to be disposed on the window glass in which one antenna element 7 is disposed at a position different from the upper or lower end portions of the two antenna elements 6 (see FIG. 10), or in which the two antenna elements 6 are disposed at vertically different positions (see FIGS. 13 and 14) can assure reception performance substantially equivalent to that of the antenna of pattern 2 shown in FIG. 10.

Figure 22:
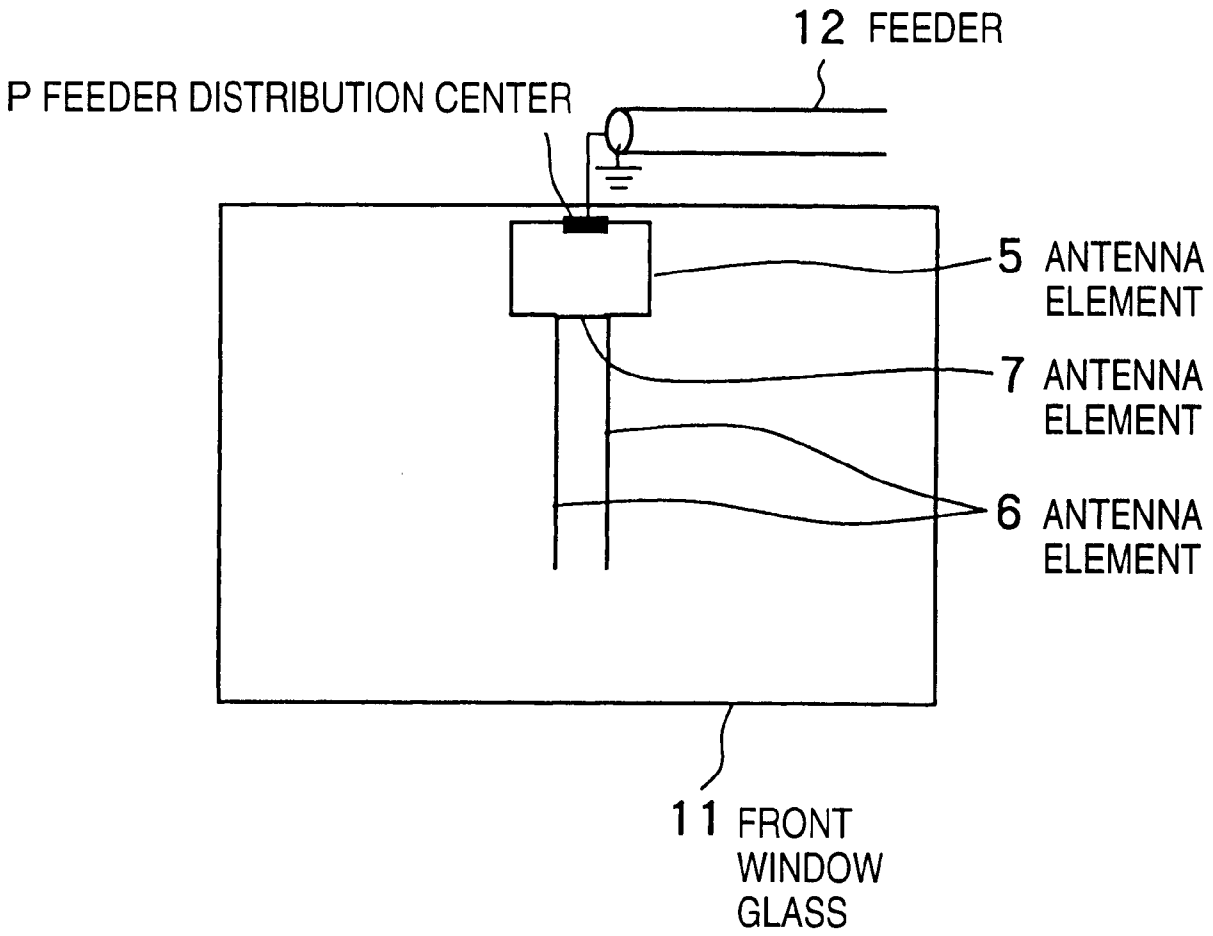
FIG. 22 is a view showing an antenna structure for a vehicle according to the third modification of the second embodiment.

Furthermore, as in a modification shown in FIG. 22, an antenna structure in which the antenna elements 5 and 7 are connected in a DC manner to form a rectangular loop, and the two antenna elements nearly vertically descend from the lower side of that rectangle toward the lower edge of the front window glass 11 can assure reception performance substantially equivalent to that of the antenna of pattern 2 shown in FIG. 10.

[Evaluation of Influences of Conductive Pattern Disconnection of Antenna Elements on Reception Performance]

Changes in reception performance due to conductive pattern disconnections formed in the antenna of pattern 3 shown in FIG. 13 will be described below.

In the reception performance evaluation tests of the present applicant, the reception performances obtained when the conductor of one of the two antenna elements 6 of the antenna of pattern 3 shown in FIG. 18 was disconnected at CUT1, and is disconnected at CUT2 were compared with that of the normal antenna of pattern 3.

The evaluation tests were conducted for antennas of pattern 3 (two of which were respectively disconnected at CUT1 and CUT2, and one of which was normal) based on the dimensions of the antenna of pattern 2 shown in FIG. 10, and also for the conventional A-pillar antenna which is not partially disconnected in terms of its structure, as a comparative example.

<Reception Performance Evaluation of FM Wave>

Figure 19:
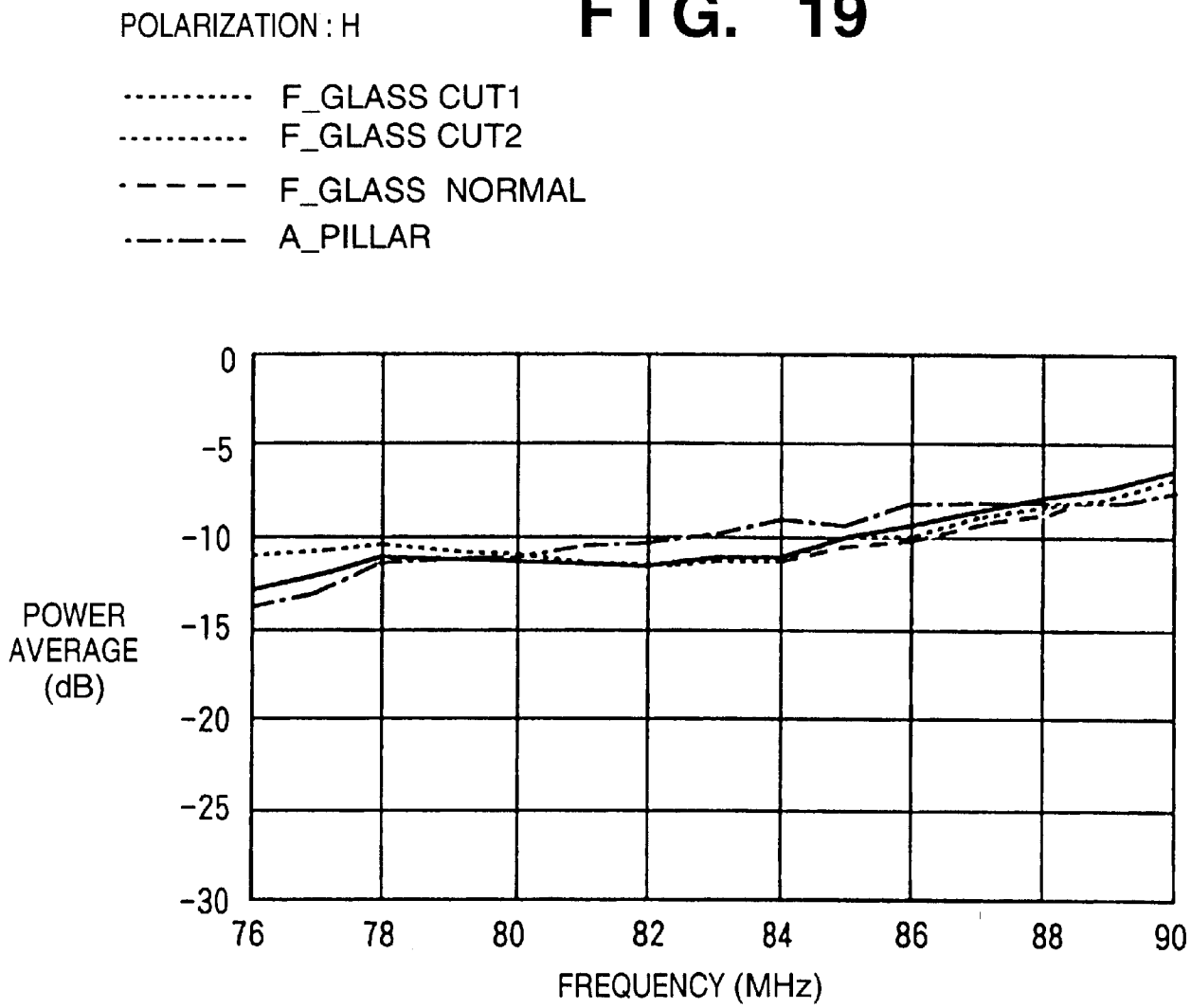
FIG. 19 is a graph showing the comparison results of reception performances of horizontally polarized FM wave upon disconnecting an antenna of pattern 3.
Figure 20:
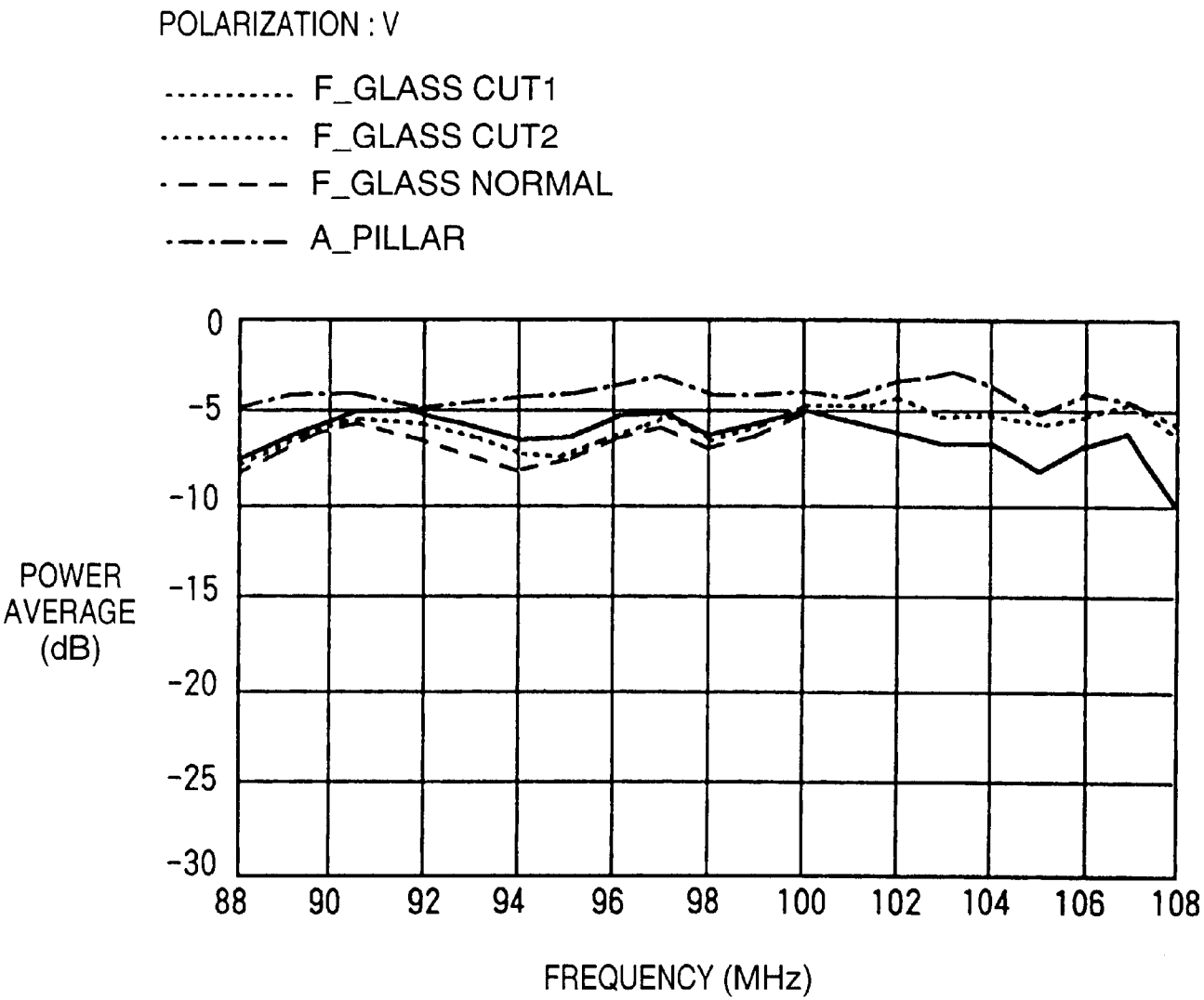
FIG. 20 is graph showing the comparison results of reception performances of vertically polarized FM wave upon disconnecting an antenna of pattern 3.

FIG. 19 is a graph showing the comparison results of the reception performances of horizontally polarized FM wave upon disconnecting the antenna of pattern 3. FIG. 20 is a graph showing the comparison results of the reception performances of vertically polarized FM wave upon disconnecting the antenna of pattern 3. FIG. 21 is a table showing the comparison results of the reception sensitivity average values of horizontally and vertically polarized FM waves upon disconnecting the antenna of pattern 3.

As can be seen from examinations of the results shown in FIGS. 19 to 21, the antenna of pattern 3 can assure reception sensitivity nearly equivalent to that of the normal antenna even when it is disconnected at CUT1 or CUT2. Even upon comparison with the A-pillar antenna, the antenna of pattern 3 realizes substantially equivalent reception sensitivity in case of horizontal polarization, and suffers a loss difference of around 2 dB as that of the normal antenna in case of vertical polarization.

<Reception Performance Evaluation of AM Wave>

The present applicant also made the aforementioned measurements for AM wave of the antennas of pattern 3 disconnected at CUT1 and CUT2, and the normal antenna of pattern 3. In these cases, the antennas of pattern 3 had reception performances around 2 dB better than the A-pillar antenna.

As described in the first embodiment, a change in vertical length of the antenna element fatally influences the original reception sensitivity of the antenna element. However, as can be seen from these evaluation results using the antennas of pattern 3, since the antenna of this embodiment has the two vertical antenna elements 6 and also the antenna element 7 that couples these elements, even when the antenna of pattern 3 shown in FIG. 18 is disconnected at, e.g., CUT1 or CUT2 of the vertical antenna element 6, a practical change in vertical length of the antenna of pattern 3 as a whole can be minimized.

As described above, according to the antenna structure for a vehicle according to this embodiment, FM and AM waves can be satisfactorily received on the front window glass without disturbing driver's sight. Especially, in this embodiment when the antenna element 7 is disposed as a print antenna on the front window glass 11 and the antenna element 6 is disconnected at any position, the predetermined effective length of the antenna as a whole can be prevented from becoming extremely short, thus minimizing deterioration of required reception performance.

Note that the appended claims of the present invention express the shape of the first antenna element as a C shape. However, the present invention is not limited to such specific shape. Any other shapes of the first antenna elements are included in the scope of the present invention as long as they have openings facing the lower edge portion of the front window glass like a shape having an opening at the central portion of the lower side of a rectangular pattern as in the above embodiment.

As many apparently widely different embodiments of the present invention can be made without departing from the spirit and scope thereof, it is to be understood that the invention is not limited to the specific embodiments thereof except as defined in the appended claims.

What is claimed is:

1. An antenna structure for a vehicle, which includes a loop-shaped first antenna element disposed near an upper edge portion of a front window glass so as to receive FM and It waves, comprising:

one second antenna element which is connected in a DC manner to a lower side portion of the loop shape defined by said first antenna element, and has a lower end portion vertically descending toward a lower edge portion of the front window glass; and a feeder distribution center provided to an upper side portion of the loop shape defined by said first antenna element.

2. The structure according to claim 1, wherein said first and second antenna elements are formed of silver paste containing dark carbon particles.

3. The structure according to claim 1, wherein said first and second antenna elements are disposed on the front window glass as print antenna elements.

4. The structure according to claim 1, wherein said first antenna element is formed into a reverse-convex shape, and a base of a rearview mirror is disposed inside the reverse-convex shaped portion.

5. The structure according to claim 1, wherein at least said second antenna element is disposed at substantially the center of the front window glass in the widthwise direction of the vehicle.

6. The structure according to claim 1, wherein said first antenna element is disposed on the front window glass above a level of a lower end portion of a rearview mirror.

7. The structure according to claim 1, wherein a shield member is provided between said second antenna element and an electronic device equipped inside an instrument panel below the front window glass to shield electrical connection therebetween.

8. The structure according to claim 7, wherein the shield member is conductive paint applied to a cover of the instrument panel.

9. The structure according to claim 7, wherein the shield member is a cover of the instrument panel which is made of a conductive resin material.

10. The structure according to claim 7, wherein the shield member is a conductive planar material disposed along the instrument panel.

11. The structure according to claim 7, wherein the shield member is a conductive mesh material which is disposed along the instrument panel.

12. An antenna structure for a vehicle, which is disposed on a front window glass so as to receive FM and AM waves and includes a C-shaped first antenna element which is disposed near an upper edge portion of the front window glass and has an opening facing a lower edge portion of the front window glass, and two second antenna elements which are respectively connected to ends of the C-shaped opening defined by said first antenna element, and substantially vertically descend toward the lower edge portion of the front window glass to have a spacing smaller than a maximum width of said first antenna element in a widthwise direction of a vehicle, comprising:

a third antenna element which is connected in a DC manner to positions different from lower end portions of said second antenna elements so as to connect said two second antenna elements to each other; and a feeder distribution center provided to an upper side portion of the C shape defined by said first antenna element.

13. The structure according to claim 12, wherein said first to third antenna elements are formed of silver paste containing dark carbon particles.

14. The structure according to claim 12, wherein said third antenna element is disposed on the front window glass at a level of a back surface of a rear view mirror.

15. The structure according to claim 12, wherein said third antenna element is connected at positions different from upper end portions of said two second antenna elements.

16. The structure according to claim 12, wherein said third antenna element is connected to upper end portions of said two second antenna elements.

17. The structure according to claim 12, wherein said third antenna element is connected to upper end portions of said two second antenna elements to define a loop shape together with said C-shaped first antenna element.

18. The structure according to claim 12, wherein a plurality of third antenna elements equivalent to said third antenna element are disposed at vertically different positions of said two second antenna elements.

19. The structure according to claim 12, wherein said third antenna element is substantially horizontally disposed.

20. The structure according to claim 12, wherein at least said second antenna element is disposed at substantially the center of the front window glass in the widthwise direction of the vehicle.

21. The structure according to claim 12, wherein said first antenna element is disposed on the front window glass above a level of a lower end portion of a rearview mirror.

22. The structure according to claim 12, wherein a shield member is provided between said second antenna element and an electronic device equipped inside an instrument panel below the front window glass to shield electrical connection therebetween.

23. The structure according to claim 22, wherein the shield member is conductive paint applied to a cover of the instrument panel.

24. The structure according to claim 22, wherein the shield member is a cover of the instrument panel which is made of a conductive resin material.

25. The structure according to claim 22, wherein the shield member is a conductive planar material disposed along the instrument panel.

26. The structure according to claim 22, wherein the shield member is a conductive mesh material which is disposed along the instrument panel.

* * * * *